US005348472A

United States Patent [19]

Joeckel et al.

[11] Patent Number: 5,348,472

[45] Date of Patent: Sep. 20, 1994

[54] VERSATILE DENTAL DELIVERY SYSTEM

[75] Inventors: Klaus H. Joeckel; Duronnie L. Harrell, both of Charlotte, N.C.

[73] Assignee: The Pelton & Crane Company, Charlotte, N.C.

[21] Appl. No.: 54,702

[22] Filed: Apr. 28, 1993

[51] Int. Cl.[5] ..... A61G 15/00

[52] U.S. Cl. ..... 433/79; 433/77

[58] Field of Search ..... 433/77, 78, 79

[56] References Cited

U.S. PATENT DOCUMENTS

| | | | |
|---|---|---|---|
| 3,823,475 | 7/1974 | Heubeck | 433/77 |
| 4,249,900 | 2/1981 | Hoelzer et al. | 433/79 |
| 4,427,382 | 1/1984 | Hoffmeister et al. | 433/79 |
| 4,501,557 | 2/1985 | Tamura et al. | 433/79 |
| 4,934,933 | 6/1990 | Fuchs | 433/79 |

FOREIGN PATENT DOCUMENTS

| | | | |
|---|---|---|---|
| 2426291 | 1/1975 | Fed. Rep. of Germany | 433/77 |

*Primary Examiner*—John J. Wilson

*Attorney, Agent, or Firm*—Mark H. Jay

[57] ABSTRACT

A station assembly for use with a patient chair is disclosed. The station assembly includes a mounting bracket which can be attached to the patient chair. A first station arm and a second station arm are pivotally mounted to the mounting bracket such that they have nested translational paths when pivoted. Instrument stations are mounted to the station arms such that either station can be brought to either side of the patient chair by pivoting the station arms.

18 Claims, 5 Drawing Sheets

VERSATILE DENTAL DELIVERY SYSTEM

BACKGROUND OF THE INVENTION

A. Field of the Invention

This invention relates to dental chairs and dental instrument delivery systems.

B. Related Art

Dental delivery systems typically include at least two stations: the dentist's instrument station and the assistant's instrument station. These stations are placed in a variety of positions around the dental patient chair depending on preference or factors related to the type of procedure being performed. For example, in some dental offices the dentist and the assistant will often sit facing each other, one on each side of the dental chair. The dentists equipment delivery stations is positioned at the dentists working hand (to the dentists right for a right handed dentist and to the dentists left for a left handed dentist) and in the direction of the foot of the patient chair. The assistant's station will be similarly positioned at the assistants working arm and in the direction of the head of the patient chair. In other dental offices, the dentist and the assistant will more often sit facing the patient, one on each side of the patient chair, with their respective stations in front of them positioned in the direction of the head of the patient chair. In yet other dental offices the dentist's instrument station is positioned over the patients lap and the assistants instrument station is positioned at the assistants working hand. In any event, depending on preference or other factors, the dentist and assistant may desire to place the stations in various positions relative to themselves and/or the patient.

In order to provide flexibility in positioning of the assistants station and the dentist's station, it is known in the art to provide the stations on a cabinet having wheels. While this solution is flexible, the cabinets take up space on the dental office floor and may get in the way of the dentist and assistant when not in use. It is also known in the art to provide the assistant's station on a pivoting arm extending from a cabinet behind the patient chair and the dentists station mounted on an pivoting arm connected to a structure which runs over and around the dental chair. While this solution also provides flexibility, it requires an additional structure and does not enable positioning of both stations along the entire ISO circle surrounding the patients mouth.

Thus a flexible dental delivery system is needed which can be easily installed, reconfigured and stored and which can accommodate a full range of positioning the two stations around the patient chair.

SUMMARY OF THE INVENTION

The present invention comprises a station assembly for use with a patient chair. The station assembly includes two station arms that are pivotally mounted to patient chair such that they have nested translational paths when pivoted. Instrument stations are mounted to the station arms such that either station can be brought to either side of the patient chair by pivoting the station arms.

BRIEF DESCRIPTION OF THE DRAWINGS

The invention will be better understood by reference to the drawings, in which.

Like reference numerals appearing in more than one figure represent like elements.

DETAILED DESCRIPTION OF THE PREFERRED EMBODIMENT

Figure 1:
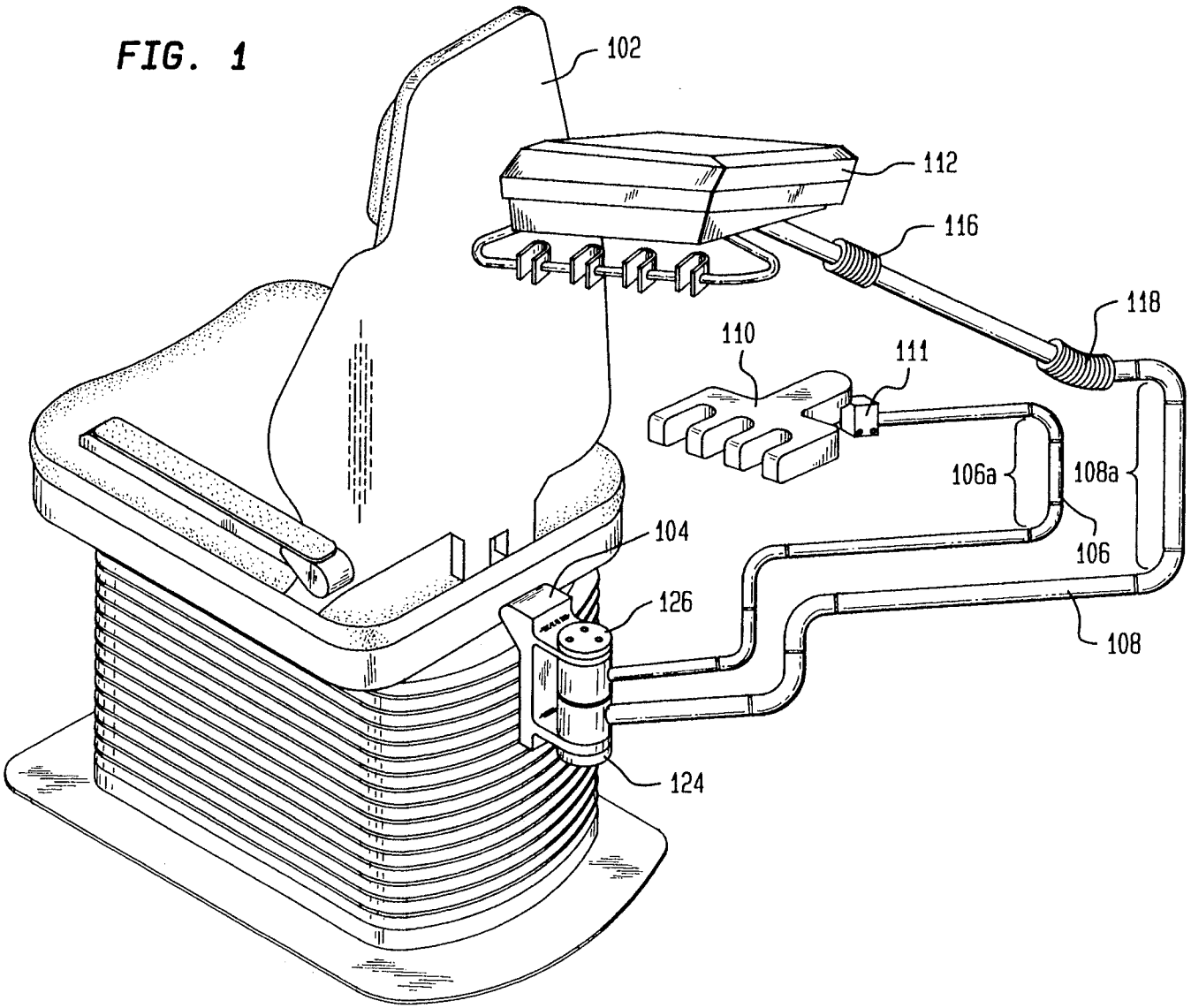
FIG. 1 is a rear isometric view of a patient chair according to an embodiment of the present invention.

A patient chair, according to an embodiment of the present invention, is illustrated in FIG. 1. The patient chair 102 has a bracket (mounting plate) 104 mounted to the top of its base at the rear such that it will raise and lower with the adjustment of the chair itself. The mounting plate 104 is attached to the patient chair 102 by bolts to allow for installation on existing chairs. Two arms 106, 108 are pivotally mounted to the bracket such that they can be moved along a plane parallel to the floor.

The assistant's instrument station 110 is mounted to a first one of the arms (the assistants station arm) 106 by way of a swivel connector 111 such that it can swivel at least 180 degrees along a plan parallel to the floor. The dentist's instrument station 112 is mounted to a second arm 108 (the dentist's station arm) 108 by a second swivel connector 114 (shown in FIG. 3) of the same type used the assistant's instrument station 110.

The assistants station arm 106 is shaped such that it can rotate through the dentists station arm 108 thus enabling both the dentist's and assistant instrument stations 110, 112 to be positioned on either side of the patient chair 102. A "C" shaped portion 106*a* of the assistant's station arm 106 fits within a similar "C" shaped portion 108*a* on the dentist's station arm 108 such that the translational path of the assistant's station arm is nested within the translational path of dentist's station arm.

Figure 5:
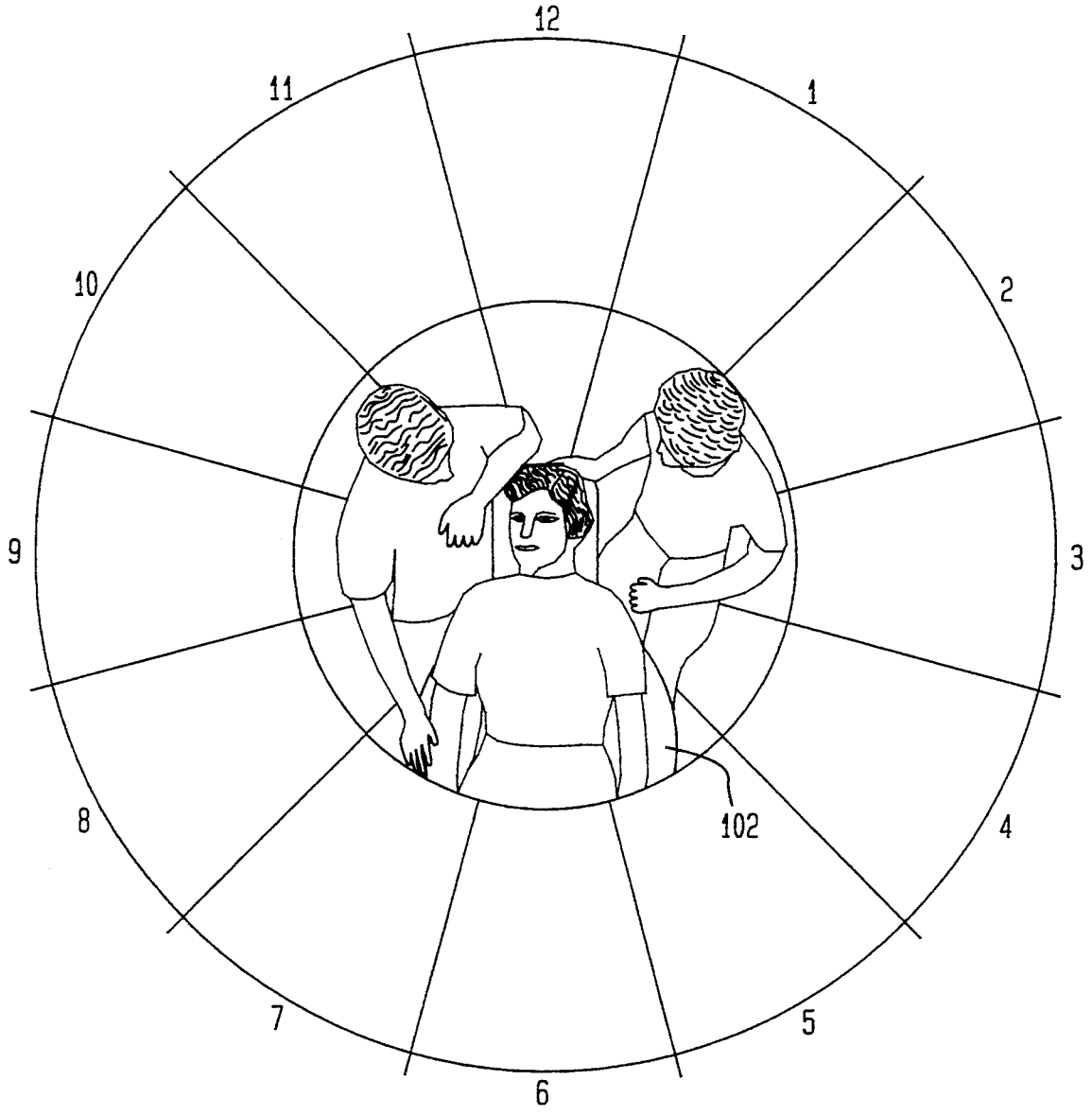
FIG. 5 depicts a 360 degree ISO circle.

Each of the arms 106, 108 can be rotated approximately 120 degrees to the left and right of center. Further, the dentists station arm 108 includes two articulated joints 116, 118, each having full three dimensional freedom of motion. Optionally, the bracket, the swivel connectors and the articulated joints can be provided with detents to provide locking of the arms 106, 108 in preferred positions. The combination of the pivot mounting, the swivel brackets and the articulated joints enable each of the stations 110, 112 to be positionable throughout the full 360 degree ISO circle around the patients head. An ISO circle (as illustrated in FIG. 5) is the normal operatory working positions as defined by the international standards organization (ISO) for the doctor and assistant when working around a patients head.

Figure 2:
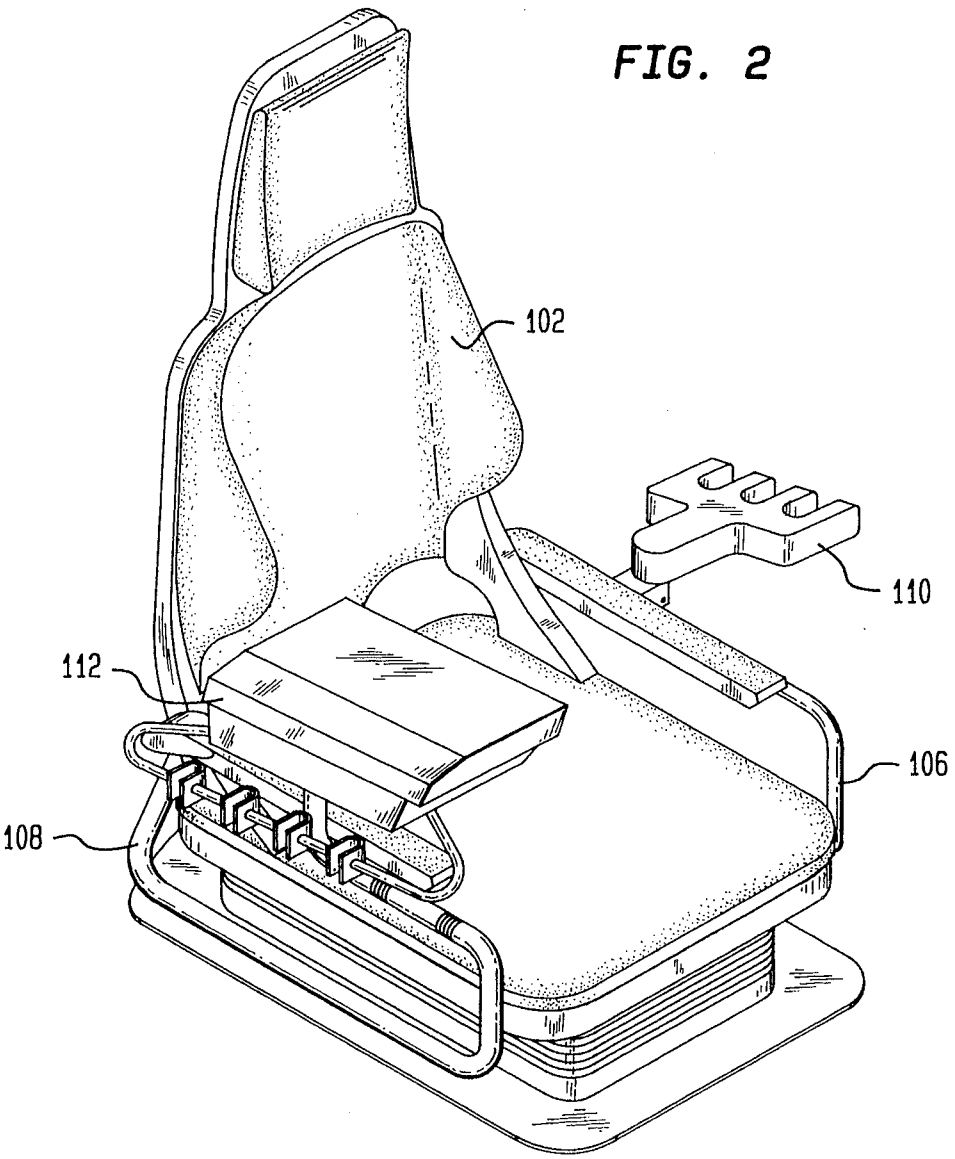
FIG. 2 is a front isometric view of the patient chair of FIG. 1 in a lowered position.

Another view of the instrument stations in one of their achievable positions is illustrated in FIG. 2. Advantageously, each of the stations can be pivoted such that either or both can be positioned over the chair seat. The enables either or both of the stations to be positioned over a patients lap. Further the chair can be put into the down position when unused and the stations can be stored over the chair seat thus taking up less office space.

Figure 4:
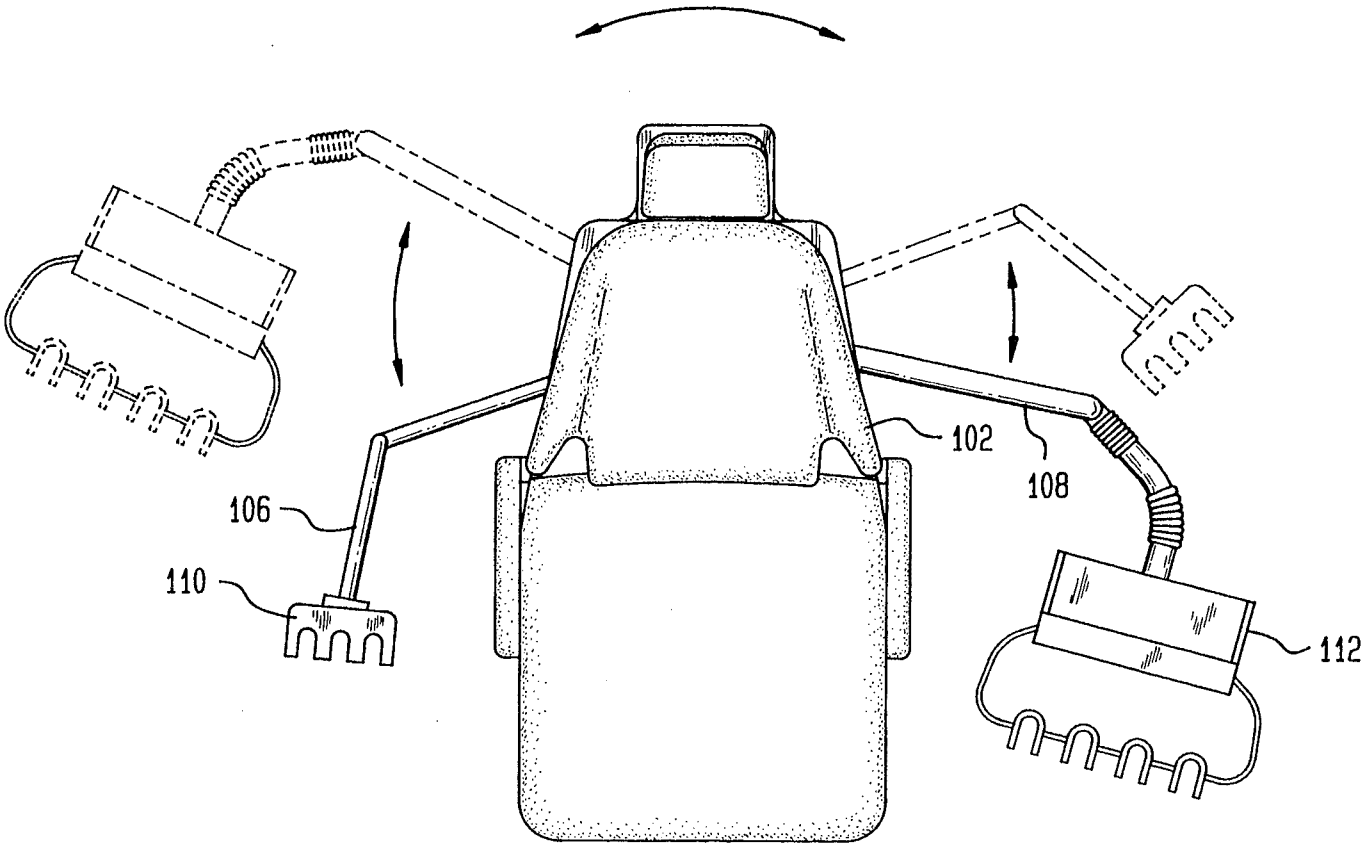
FIG. 4 is a front view of the patient chair of FIG. 2 showing the movement of the station arms.

The general motion of the dental stations and assistants station arms relative to the patient chair is better illustrated in FIG. 4. Again, either or both or the stations can be further adjusted so as to be positioned over the patients lap.

Figure 3:
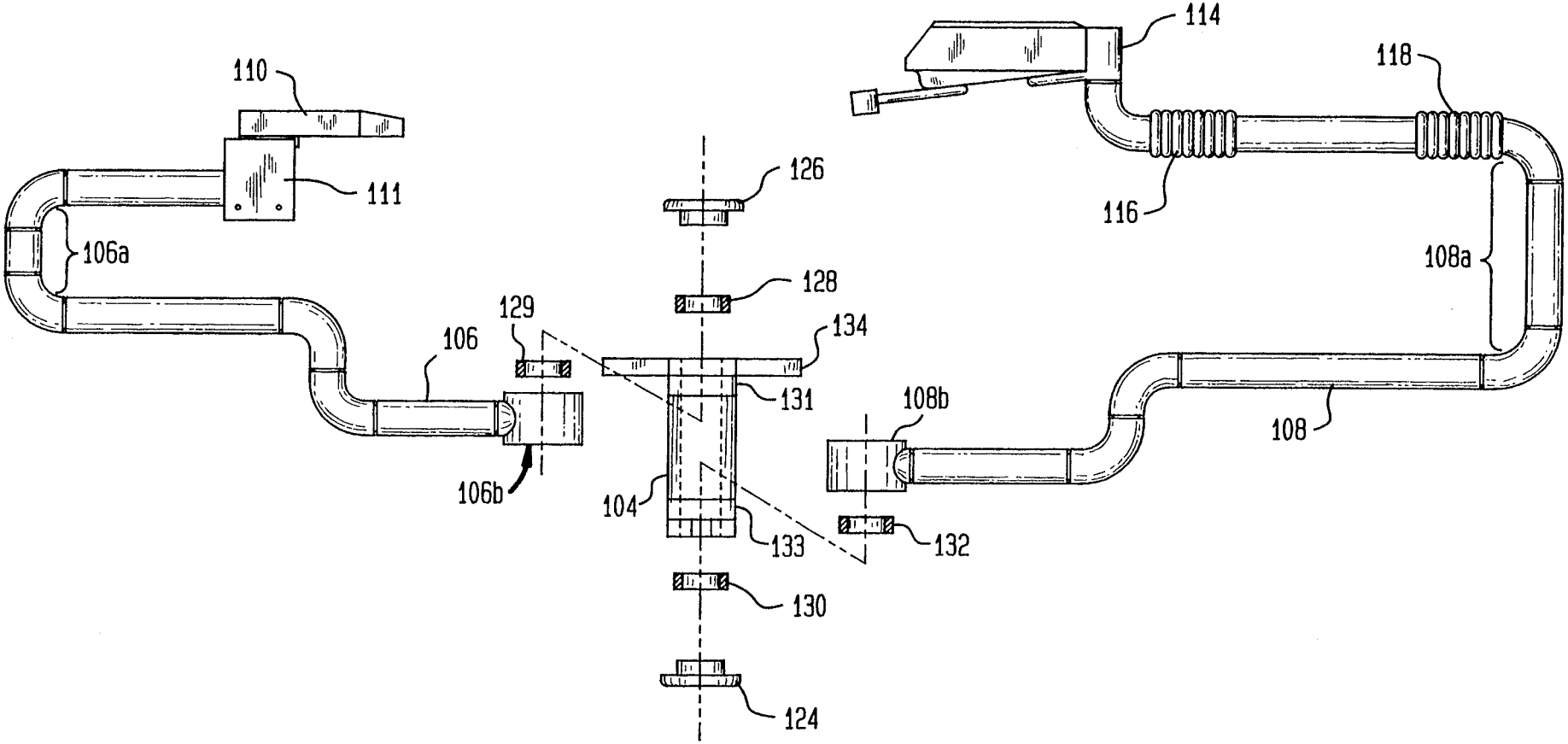
FIG. 3 is a detailed view of the station arm assembly according to an embodiment of the present invention.

A more detailed diagram of the stations, arms and mounting bracket, joints and swivel connectors is shown in FIG. 3. Retainer plates 124, 126 extend through the mounting plate 104 and into the dentist's and assistant's station arms 108, 106. Roller bearings 128, 129, 130, 132 are positioned on both sides of each of the mounting plate lips 131, 133, one between the retainer plate and the lip and the other between the arm mounting portion and the lip. The retainer plates are attached to the arms by screws (not shown) which are received by threaded holes in the mounting portions 106*b*, 108*b* of the arms. When the screws are tightened, each arm mounting portion and its associated retainer plate interact with the bearings such that the arms 106, 108 can swivel freely and easily. As best seen in FIG. 3, the mounting plate 104 includes a plate portion 134 which attaches to the patient chair under the seat.

The station arms 106, 108 are preferably made of hollow metal tubes (e.g. extruded aluminum) having a plastic cover. As an alternative, any hollow metal or plastic tubing of sufficient strength can be used. The mounting portions of the arms, include mounting hardware for receiving the retainer plate screws. Supply cables are fed to the stations through the arms and exit to the bottom of the patient chair.

Now that the invention has been described by way of the preferred embodiment, various enhancements and improvements which do not depart from the scope and spirit of the invention will become apparent to those of skill in the art. Thus it should be understood that the preferred embodiment has been provided by way of example and not by way of limitation. The scope of the invention is defined by the appended claims.

We claim:

1. A station assembly for use with a patient chair, comprising:

a mounting plate attachable to the patient chair;

a first station arm pivotally mounted to the mounting plate;

a second station arm pivotally mounted to the mounting plate, the first station arm and the second station arm being shaped such that they have nested translational paths when pivoted a first instrument station mounted to the first station arm; and, a second instrument station mounted to the second station arm;

wherein the first station arm has a first generally "C" shaped portion and wherein the second station arm has a second generally "C" shaped portion, the first generally "C" shaped portion having a translational path within the second generally "C" shaped portion when the first station arm is pivoted from the mounting plate.

2. The station assembly of claim 1 the first station is pivotally mounted to the first station arm.

3. The station assembly of claim 1 wherein the mounting plate is connected to a rear portion of the patient chair and wherein the first station arm and second station arm are pivotally mounted such that both the first station arm and the second station arm can pivot at least 120 degrees in either direction from center.

4. The station assembly of claim 1 wherein said second station arm includes at least one flexible joint having three dimensional freedom of motion.

5. The station assembly of claim 4 wherein the second instrument station is pivotally mounted to the second station arm.

6. The station assembly of claim 4 wherein each of the first and second station arm are positionable such that any of the first station and the second station can be located above a patients lap when the patient is seated on the patient chair.

7. The station assembly of claim 6 wherein the hollow tubes are made of plastic.

8. The station assembly of claim 6 wherein the hollow tubes are made of metal and coated with plastic.

9. The station of claim 1 wherein the first station assembly arm and the second station arm are formed of hollow tubes having instrument cabling for the first instrument station and the second instrument station passed therethrough.

10. A patient chair assembly, comprising:

a height adjustable patient chair;

a mounting plate attached to a height adjustable portion of the patient chair, said height adjustable portion being at a rear location on the patient chair;

a first station arm pivotally mounted to the mounting plate;

a second station arm pivotally mounted to the mounting plate, the first station arm and the second station arm being shaped such that they have nested translational paths when pivoted;

a first instrument station mounted to the first station arm; and, a second instrument station mounted to the second station arm;

wherein the first instrument station and the second instrument station will move with the patient chair when the height of the patient chair is adjusted.

11. The station assembly of claim 10 wherein each of the first and second station arm are positionable such that any of the first station and the second station can be located above a patients lap when the patient is seated on the patient chair.

12. The patient chair assembly of claim 10 wherein the first station arm has a first "C" shaped portion and wherein the second station arm has a second generally "C" shaped position, the first generally "C" shaped portion having a translational path within the second "C" shaped portion when the first station arm is pivoted from the mounting plate.

13. The patient chair assembly of claim 12 wherein the first station arm and second station arm are pivotally mounted such that both the first station arm and the second station arm can pivot at least 120 degrees in either direction from center.

14. The patient chair assembly of claim 13 wherein second station arm includes at least one flexible joint having three dimensional freedom of motion.

15. The patient chair assembly of claim 14 wherein the first station arm and the second station arm are formed of hollow tubes having instrument cabling for the first instrument station and the second instrument station passed therethrough.

16. The patient chair assembly of claim 15 wherein the second instrument station is pivotally mounted to the second station arm.

17. The patient chair assembly of claim 16 wherein the hollow tubes are made of plastic.

18. The patient chair assembly of claim 17 wherein the hollow tubes are made of metal and coated with plastic.

* * * * *